United States Patent [19]

Yoshizawa et al.

[11] Patent Number: 5,008,231

[45] Date of Patent: Apr. 16, 1991

[54] HEAT SENSITIVE RECORDING MATERIAL

[75] Inventors: Katsuaki Yoshizawa, Amagasaki; Yoshitaka Oeda, Ikoma, both of Japan

[73] Assignee: Kanzaki Paper Manufacturing Company Limited, Tokyo, Japan

[21] Appl. No.: 356,950

[22] Filed: May 25, 1989

[30] Foreign Application Priority Data

May 31, 1988 [JP] Japan ..... 63-134808

[51] Int. Cl.[5] ..... B41M 5/18

[52] U.S. Cl. ..... 503/207; 427/152; 503/200; 503/214; 503/226

[58] Field of Search ..... 503/200, 207, 226, 214; 428/342; 427/150–152

[56] References Cited

U.S. PATENT DOCUMENTS 4,168,845 9/1979 Oeda et al. ..... 428/913

4,626,877 12/1986 Arai et al. ..... 503/200

FOREIGN PATENT DOCUMENTS 58-47999 10/1983 Japan ..... 503/200

*Primary Examiner*—Pamela R. Schwartz

*Attorney, Agent, or Firm*—Larson and Taylor

[57] ABSTRACT

Disclosed is a heat-sensitive recording material comprising a support; a heat-sensitive recording layer formed over the support and containing a color forming material, a color developing material which forms a color on contact with the color forming material and a pigment which is about 80 to about 400 ml/100 g in oil absorption according to JIS K 5101 and about 3 to about 15 μm in average particle size; and an overcoat layer formed over the heat-sensitive recording layer and comprising a binder and a pigment, wherein the pigment is used in an amount of about 0.5 to about 3.0 parts by weight per part by weight of the binder and the coating amount of the overcoat layer is about 0.3 to about 2.0 g/m$^2$ on dry basis.

14 Claims, No Drawings

HEAT SENSITIVE RECORDING MATERIAL

The present invention relates to a heatsensitive recording material and particularly to a heatsensitive recording material of high sensitivity which is excellent in ability to fix the print of a seal, pencil writability and anti-scratching property and in which the surface of the recording material is low in glossiness.

Heat-sensitive recording methods comprise the steps of heating a thermal head in response to input signals and bringing a color developing material and a color forming material into contact with each other by melting these two materials on the recording material which is in contact with the thermal head. Since the recording by this recording method can be carried out with a minimal wear of the thermal head at a recording speed commensurate with the amount of data present within the band which can be transmitted by a telephone line, this recording method has been rapidly introduced into use in the field of information machines such as printers, facsimile machines and the like.

With a recent remarkably increasing amount of information, attempts have so far been made to develop high-speed recording machines (type G-III) and ultra-highspeed recording machines (type G-IV). With such development of the recording machines adapted for highspeed recording, there arises a demand for a heat-sensitive recording material which has higher sensitivity than ever.

However, since heat-sensitive recording materials of high sensitivity generally have a recording layer having highly smooth surface, such recording materials have inferior ability to fix seal print, inferior pencil writability and high glossiness, and they are far different in properties from ordinary paper used for usual office work. It is strongly desired to develop, by obviating such problems, a heat-sensitive recording material of high sensitivity having an appearance and a touch or feel of ordinary wood free paper.

The term "ability to fix seal print" herein used implies such property of the recording material that even when the seal print formed by affixing to the recording material with use of a cinnabar seal-ink is rubbed with a finger or the like after relatively short period of time (e.g., 5 to 10 seconds) from affixing, the seal print is not soiled and maintains its distinct contours. The term "pencil writability" means such property of recording material that when written with a pencil on recording material, the same feeling as on wood-free paper is imparted to pencil tip and the marks are given the same density as when written with a pencil on ordinary paper.

Examined Japanese Patent Publication No. 47999/1983 discloses a heat-sensitive recording material comprising a recording layer that contains an inorganic pigment having a specific oil absorption and a large particle size in order to suppress the adhesion of residuary substance to the thermal head as well as sticking. According to the research conducted by the present inventors, it has been revealed that this heatsensitive recording material is not only improved with respect to the suppression of adhesion of residuary substance and sticking but also outstanding in ability to fix seal print and pencil writability, low in glossiness of the surface of the recording layer and thus has an appearance and a touch or feel (hand feeling) quite similar to that of ordinary paper.

The term "the adhesion of residuary substance" as used herein means a phenomenon that the heat-fusible materials present in a heat-sensitive recording layer adheres to and piles up on the thermal head as a residuary substance when the thermal head is heated for recording. The term "sticking" means a phenomenon that the heatsensitive recording material itself sticks to the thermal head as the recording material is heated for recording and then cooled thereafter, and in an extreme case sticking disturbs a smooth travel of the recording material and impairs the recording.

However, the recording material disclosed in the foregoing Examined Japanese Patent Publication No. 47999/1983 has the drawback that it is inferior in so-called "anti-scratching property" and thus if the recording layer is scratched with a fingernail or the like, an undesired image is formed.

On the other hand, another technique is also known which is designed for improving the properties of the recording material such as water resistance, resistance to solvent, resistance to diazo developer and the like by forming, over the heat-sensitive recording layer, a protective layer consisting of a water-soluble polymer or the like. According to the research of the present inventors, the formation of such protective layer on the heat-sensitive recording layer improves the antiscratching property but at the same time causes the disadvantage that the aforementioned ability to fix seal print and recording density are impaired.

As seen from the above, the prior art heatsensitive recording materials are not fully satisfactory in at least one of the foregoing various properties such as ability to fix seal print and the like, and there have not been developed a recording material which is improved in all of the foregoing properties to a fully satisfactory extent.

An object of the present invention is to provide a heat-sensitive recording material which is excellent in ability to fix seal print, pencil writability and antiscratching property, which is low in glossiness of the surface of the recording material and has an appearance and hand feeling similar to those of ordinary paper, which can give record images at a higher recording density and which is free of the problems such as adhesion of residuary substance and sticking.

The present invention provides a heat-sensitive recording material comprising (a) a support; (b) a heatsensitive recording layer formed over the support and containing a color forming material, a color developing material which forms a color on contact with the color forming material and a pigment which is about 80 to about 400 ml/100 g in oil absorption according to JIS K 5101 and about 3 to about 15 $\mu$m in average particle size; and (c) an overcoat layer formed over the heat-sensitive recording layer and comprising a binder and a pigment wherein the pigment is used in an amount of about 0.5 to about 3.0 parts by weight per part by weight of the binder and the coating amount of the overcoat layer is about 0.3 to about 2.0 g/m$^2$ on dry basis.

In an attempt to achieve the foregoing object of the invention, we conducted extensive research on the structure of the heat-sensitive recording layer and on the composition of the overcoat layer to be provided on the recording layer. Consequently, we found that the above object can be attained by incorporating into the heatsensitive recording layer a pigment having a specific oil absorption and a specific particle size as described hereinbefore and forming an overcoat layer over the recording layer with use of a specific amount of a coating composition comprising a pigment and a binder in specific proportions. The present invention has been accomplished based on these findings.

The heat-sensitive recording material according to the present invention is excellent in all of ability to fix seal print, pencil writability and anti-scratching property, low in glossiness of the surface of the recording material and has an appearance and hand feeling similar to those of ordinary paper. Further, the recording material according to the present invention can produce record images of high recording density and is free of the problems such as adhesion of residuary substance and sticking.

For producing such excellent effects, it is essential in the present invention that the heat-sensitive recording layer contains a pigment having the abovespecified oil absorption and particle size, that the overcoat layer contains a pigment and a binder in the above-specified proportion and that the coating amount of the overcoat layer is adjusted to the above-specified range.

In the present invention, usable as the support are those conventionally used in the art and made of paper, a plastic film, synthetic fiber paper or the like. When required, an undercoat layer may be formed over the support or the support may be supercalendered, and then coating composition for heat-sensitive layer formation can be applied to the support.

Examples of the combination of color forming material and color developing material are the combination of a colorless or pale-colored basic dye and an acidic material, the combination of ferric stearate or like metal salt of higher fatty acid and gallic acid or like phenols and the combination of a diazonium compound and a coupler compound, etc.

Among these substances, various kinds of colorless or pale-colored basic dyes are known and include the following dyes: 3,3-bis(p-dimethylaminophenyl)-6-dimethylaminophthalide, 3,3-bis(p-dimethylaminophenyl)phthalide, 3-(pdimethylaminophenyl)-3-(1,2-dimethylindol-3-yl)phthalide, 3-(p-dimethylaminophenyl)-3-(2-methylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-6-dimethylaminophthalide, 3,3bis(2-phenylindol-3-yl)-6-dimethylaminophthalide, 3-p-dimethylaminophenyl-3-(1-methylpyrrol-3-yl)-6-dimethylaminophthalide and like triarylmethane-based dyes; 4,4'-bis-dimethylaminobenzhydrylbenzylether, N-halophenylleucoauramine, N-2,4,5-trichlorophenyl-leucoauramine and like diphenylmethane-based dyes; benzoyl-leucomethylene blue, p-nitrobenzoyl-leucomethylene blue and like thiazine-based dyes; 3-methyl-spiro-dinaphthopyrane, 3-ethyl-spiro-dinaphthopyrane, 3-phenyl-spirodinaphthopyrane, 3-benzyl-spiro-dinaphthopyrane, 3-methylnaphtho(6'-methoxybenzo)spiropyrane, 3-propyl-spirodibenzopyrane and like spiro-based dyes; rhodamine-B-anilinolactam, rhodamine-(p-nitroanilino)lactam, rhodamine-(o-chloroanilino)lactam and like lactam-based dyes; 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7chlorofluoran, 3-diethylamino-6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-N-methyl-N-benzylaminofluoran, 3-diethylamino-7-N-chloroethyl-N-methylaminofluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-dibutylamino-6-methyl-7-phenylaminofluoran, 3-diethylamino-7-(2-carbomethoxy-phenylamino)fluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, 3-(N-methyl-N-n-amyl-)amino-6-methyl-7-phenylaminofluoran, 3-(N-ethyl-N-n-amyl)amino-6-methyl-7-phenylaminofluoran, 3-(N-ethyl-N-isoamyl)amino-6-methyl-7-phenylaminofluoran, 3-(N-methyl-N-n-hexyl)amino-6-methyl-7-phenylaminofluoran, 3-(N-ethyl-N-n-hexyl)amino-6-methyl-7-phenylaminofluoran, 3-(N-ethyl-N-$\beta$-ethylhexyl)amino-6-methyl-7-phenylaminofluoran, 3-(N-ethyl-N-tetrahydrofurfuryl)amino-6-methyl-7-phenylaminofluoran, 3-(N-ethyl-N-cyclopentyl)amino-6-methyl-7-phenylaminofluoran and like fluoran-based dyes, etc. Of course useful basic dyes are not limited to those exemplified above and these can be used singly or at least two of them can be used in mixture.

Further, examples of various acidic materials which are used in combination with the aforementioned basic dyes are those already known and include the following organic acidic substances: phenolic compounds such as 4-tert-butyl phenol, $\alpha$-naphthol, $\beta$-naphthol, 4-acetylphenol, 4-tert-octylphenol, 4,4'-sec-butylidenediphenol, 4-phenylphenol, 4,4'-dihydroxy-diphenylmethane, 4,4'-isopropylidenediphenol, hydroquinone, 4,4'-cyclohexylidenediphenol, 4,4'-(1,3-dimethylbutylidene)bisphenol, 2,2-bis(4-hydroxyphenyl)-4-methylpentane, 4,4'-dihydroxydiphenylsulfide, 4,4'-thiobis(6-tert-butyl-3-methylphenol), 4,4'-dihydroxydiphenylsulfone, 4-hydroxy-4'-methyldiphenylsulfone, 4-hydroxy-4'-methoxydiphenylsulfone, 4-hydroxy-4'-isopropoxydiphenylsulfone, 4-hydroxy-3',4'-trimethylenediphenylsulfone, 4-hydroxy-3',4'-tetramethylenediphenylsulfone, 3,4-dihydroxy-4'-methyldiphenylsulfone, bis(3-allyl-4-hydroxyphenyl)sulfone, 1,3-di[2-(4-hydroxyphenyl)-2-propyl]benzene, hydroquinone monobenzyl ether, butyl bis(4-hydroxyphenyl)acetate, 4-hydroxybenzophenone, 2,4-dihydroxybenzophenone, 2,4,4'-trihydroxybenzophenone, 2,2'4,4'-tetrahydroxybenzophenone, dimethyl 4-hydroxyphthalate, methyl 4-hydroxybenzoate, ethyl 4-hydroxybenzoate, propyl 4-hydroxybenzoate, secbutyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, novolak phenol resin and phenolic polymer; aromatic carboxylic acids such as benzoic acid, p-tert-butylbenzoic acid, trichlorobenzoic acid, terephthalic acid, 3-sec-butyl-4-hydroxy-benzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3,5-di-tertbutylsalicylic acid, 3-benzylsalicylic acid, 3-($\alpha$- methylbenzyl)salicylic acid, 3-chloro-5-($\alpha$-methylbenzyl)salicylic acid, 3-phenyl-5-($\alpha$, $\alpha$-dimethylbenzyl)salicylic acid, 3,5-di-$\alpha$- methylbenzylsalicylic acid and the like; and salts of the aboveexemplified phenolic compounds or aromatic carboxylic acids with polyvalent metals such as zinc, magnesium, aluminum, calcium, titanium, manganese, tin, nickel and the like, etc. Of course these can be used singly or at least two of these color developing materials can be used in mixture when so required.

The proportions of the basic dye and color developing material to be used are not specifically limited but can be suitably determined according to the kinds of the basic dye and the color developing material. Generally about 100 to about 700 parts by weight, preferably about 150 to about 400 parts by weight, of the color developing material is used per 100 parts by weight of the basic dye.

As stated above, the pigment to be incorporated into the heat-sensitive recording layer according to the invention is the pigment having an average particle size of about 3 to about 15 μm and selected from pigments having an oil absorption of 80 to 400 ml/100 g according to JIS K 5101. Examples of the pigments having such oil absorption are as follows. In the following exemplification, each value in parenthesis is oil absorption (ml/100 g) according to JIS K 5101. diatomaceous earth (110–120), calcined diatomaceous earth (130–140), flux-calcined diatomaceous earth (120–160), finely divided anhydrous aluminum oxide (80–250), finely divided titanium oxide (80–120), magnesium carbonate (80–150), finely divided anhydrous silica (100–300), magnesium aluminosilicate (300–400), agglomerate of finely divided precipitated calcium carbonate (80–100), finely divided calcium silicate (80–350), calcined clay (90–110), etc. These pigments can be used singly or at least two of them are usable in mixture. Among these pigments, finely divided anhydrous silica, agglomerate of finely divided precipitated calcium carbonate and calcined clay are preferred. The oil absorption depends on various factors such as the shape and the size of the particles of the pigment. The pigment subjected to a chemical or physical treatment so as to adjust the oil absorption to the above-defined range may also be used.

When the pigment is in the form of a secondary particle such as an agglomerate of finely divided precipitated calcium carbonate, the term "average particle size" used herein means the average particle size of such secondary particle.

Irrespective of the kinds of the pigment or binder constituting the overcoat layer, the heat-sensitive recording material according to the invention has excellent ability to fix seal print and pencil writability, low surface-glossiness and has good matching with recording machines (i.e. free of the problems such as adhesion of residuary substance or sticking) by using a pigment having the above-specified oil absorption and an average particle size of 3 to 15 μm, preferably 3 to 10 μm, for the heat-sensitive recording layer.

The use of the pigment having an oil absorption of less than 80 ml/100 g often fails to give a desired ability to fix seal print. On the other hand, if the oil absorption of the pigment to be used exceeds 400 ml/100 g, the recording density and recording sensitivity are usually reduced. Further, when, for example, the urea resin pigment having an oil absorption exceeding 400 ml/100 g is used, the coating composition prepared from such pigment is high in viscosity and is difficult to transport during coating process, and has a difficulty in adjustment of the coating amount. Therefore the present invention empolys a pigment having an oil absorption of about 80 to about 400 ml/100 g. On the other hand, the use of a pigment having an average particle size of less than 3 μm often fails to achieve the desired reduction in the glossiness of the surface of the recording material. The use of a pigment having an average particle size exceeding 15 μm usually lowers the recording density to a large extent. Accordingly in the present invention, usable as a pigment for a heat-sensitive recording layer is the one having an average particle size of about 3 to about 15 μm and selected from those having the abovespecified oil absorption.

The amount of such specific pigments in the heat-sensitive recording layer can be suitably adjusted depending on the oil absorption of the pigment to be used and the binding ability of the binders to be described hereinafter. The amount of the pigment is preferably adjusted to about 10 to about 50% by weight, preferably about 15 to about 35% by weight, based on the total solids content of the heat-sensitive recording layer so as to fully produce the effect of the addition of the pigments.

The coating composition for heat-sensitive recording layer formation containing above-mentioned materials can be prepared, for example, with use of water as a dispersing medium and with use of a stirring and pulverizing devices such as a ball mill, attritor or sand mill, by dispersing the dyes and the color developing material at the same time or separately and adding a pigment to the dispersion.

Usually the coating composition has incorporated therein a binder, such as starches, hydroxyethyl cellulose, methyl cellulose, carboxymethyl cellulose, gelatin, casein, gum arabic, polyvinyl alcohol, acetoacetylated-polyvinyl alcohol, salts, particularly sodium and like alkali metal salts or ammonium salts of diisobutylene-maleic anhydride copolymer, of styrenemaleic anhydride copolymer, of ethylene-acrylic acid copolymer, or of styrene-acrylic acid copolymer; styrenebutadiene copolymer emulsion, urea resin, melamine resin, amide resin or the like. The binder is used in an amount of about 2 to about 40% by weight, preferably about 5 to about 25% by weight, based on the total solids content of the coating composition.

Various auxiliary agents can be further admixed with the coating composition. Examples of such auxiliary agents are dispersants such as sodium dioctylsulfosuccinate, sodium dodecylbenzenesulfonate, sodium lauryl sulfate and fatty acid metal salts; defoaming agents;, fluorescent dyes and coloring dyes; etc.

Further when required, other additives can be admixed with the coating composition. Examples of such additives are waxes such as zinc stearate, calcium stearate, polyethylene wax, carnauba wax, paraffin wax and ester wax; fatty acid amides such as stearic acid amide, stearic acid methylene-bisamide, oleic acid amide, palmitic acid amide and coconut fatty acid amide; hindered phenols such as 2,2'-methylenebis(4-methyl-6-tertbutylphenol), 4,4'-butylidenebis(6-tert-butyl-3-methylphenol), 1,1,3-tris(2-methyl-4-hydroxy-5-tertbutylphenyl)butane; ethers such as 1,2-bis(phenoxy)ethane, 1,2-bis(4-methylphenoxy)ethane, 1,2-bis(3-methylphenoxy)ethane, 1-phenoxy-2-(4-methylphenoxy)ethane, 1,4-diethoxynaphthalene and 2-naphthyl benzylether; esters such as dimethylterephthalate, dibutylterephthalate, dibenzylterephthalate, 1-hydroxy-2-naphthoic acid phenyl ester; ultraviolet light absorbers such as 2-(2'-hydroxy-5'-methylphenyl)benzotriazole and 2-hydroxy-4-benzyloxybenzophenone; p-benzylbiphenyl; and various known heatfusible substances, etc.

In the present invention, the method of forming the recording layer of the heat-sensitive recording material is not specifically limited but can be any of those conventionally used. For example, the coating composition for heat-sensitive recording layer formation can be applied to the support by an air knife coater, blade coater, bar coater, gravure coater, curtain coater or other suitable means. The coating amount of the coating composition is not specifically limited and is generally adjusted to about 2 to about 12 g/m$^2$, preferably about 3 to about 10 g/m$^2$ on dry basis.

The heat-sensitive recording layer thus obtained is excellent in ability to fix seal print and pencil writability and low in surface-glossiness but inferior in anti-scratching property. According to the invention, in order to afford anti-scratcing property to the heatsensitive recording layer without impairing the other properties mentioned above, there is formed, over the recording layer, an overcoat layer which contains a binder and a pigment in an amount of 0.5 to 3.0 parts by weight per part by weight of the binder in a coating amount of 0.3 to 2.0 g/m$^2$ (on dry basis), thereby giving a heatsensitive recording material having an appearance and a touch or a feel more similar to that of ordinary paper.

In order to maintain the glossiness of the surface of the recording material at a certain low level, it is necessary that the minute irregularities which are formed by the pigment incorporated into the recording layer should remain even after forming an overcoat layer, irrespective of the particle size of the pigment to be incorporated into the overcoat layer. Further it is necessary to minimize the coating amount of the overcoat layer for avoiding the impairment of the recording density and ability to fix seal print. From these viewpoints, in the present invention, the coating amount of the overcoat layer is adjusted to about 2.0 g/m$^2$ or lower, preferably about 1.5 g/m$^2$ or lower. For obtaining fully satisfactory anti-scratching property, the coating amount of the overcoat layer must be not less than 0.3 g/m$^2$.

On the other hand, when the pigment is incorporated into the overcoat layer in an amount less than 0.5 part by weight per part by weight of the binder, the ability to fix seal print and pencil writability are impaired and the surface-glossiness can not be kept low. Conversely, the use of the pigment in an amount exceeding 3.0 parts by weight lowers the recording density. For these reasons, the amount of the pigment for use in the overcoat layer of the present invention is about 0.5 to about 3.0 parts by weight, preferably about 2.0 to about 3.0 parts by weight, per part by weight of the binder.

The kind of the pigment to be incorporated into the overcoat layer is not specifically limited. Useful pigments are precipitated calcium carbonate, ground calcium carbonate, talc, kaolin, anhydrous silica, magnesium carbonate, clay, zinc oxide, aluminum oxide, aluminum hydroxide and like inorganic pigments; and polystyrene microball, nylon powder, polyethylene powder, urea-formaldehyde resin filler, starch powder and like organic pigments, etc. The particle size of the pigment is not particularly limited, but generally those having an average particle size of about 1 to about 5 μm are preferred. Among the above-exemplified pigments, precipitated calcium carbonate, ground calcium carbonate, kaolin and anhydrous silica are preferred.

Examples of the binder for forming the overcoat layer are polyvinyl alcohol, acetoacetylated polyvinyl alcohol, carboxy-modified polyvinyl alcohol, sulfonic acid-modified polyvinyl alcohol, methyl cellulose, ethyl cellulose, hydroxyethyl cellulose, carboxymethyl cellulose, casein, gum arabic, oxidized starch, etherified starch, esterified starch, styrene-butadiene copolymer emulsion, vinyl acetate-ethylene copolymer emulsion, vinyl acetate-vinyl chloride-ethylene copolymer emulsion, methacrylate-butadiene copolymer emulsion, etc. These binders can be used singly or at least two of them are usable in mixture. Among these binders, polyvinyl alcohol and modified polyvinyl alcohols are preferred.

Further when required, various additives can be incorporated into the overcoat layer such as sodium dioctylsulfosuccinate, sodium dodecylbenzenesulfonate, sodium lauryl sulfate, alginates and fatty acid metal salts and like surfactants (as a dispersant or moisturizing agent); glyoxal, methylol melamine, potassium persulfate, sodium persulfate, ammonium persulfate, boric acid and like agents for enhancing water-resistance (crosslinking agent); benzophenone type, triazole type or like ultraviolet absorbers, defoaming agents, fluorescent dyes, coloring dyes and like auxiliary agents; and also, for enhancing the recording density, a color developing material and a heat-fusible substance (sensitizer), or a color forming material and a heat-fusible substance may be added.

The coating composition for overcoat layer formation is prepared, with use of water as a dispersing medium, by dispersing the pigment, binder and auxiliary agents and the like. The resulting coating composition may be fully mixed and dispersed with use of a mixing or agitating device such as a mixer, attritor, ball mill or roll mill if so required, and is then applied to the surface of the heat-sensitive recording layer with use of a known coating means.

The heat-sensitive recording material thus obtained according to the invention has such structure that a specific coating amount of overcoat layer predominantly containing a binder and a pigment in specific proportions is formed over the recording layer which contains a pigment having a specific oil absorption and a specific average particle size, and for this reason achieves well-balanced improvement in all of ability to fix seal print, pencil writability and anti-scratching property, is low in glossiness of the surface of the recording material, has an appearance and a touch or a feel quite similar to that of wood free paper, produces record images of high color density and thus is very suitable for high-speed recording.

The present invention will be described below in greater detail with reference to the following examples, but the invention is not limited thereto. In the examples, "parts" and "percentages" are all by weight unless otherwise indicated, and oil absorption values are determined according to JIS K 5101.

EXAMPLE 1

(1) Preparation of Dispersion A

| | |
|---|---|
| 3-(N-ethyl-N-isoamylamino)-6-methyl-7-phenylaminofluoran | 100 parts |
| 1,2-Di(3-methylphenoxy)ethane | 250 parts |
| 5% Aqueous solution of methylcellulose | 200 parts |
| Water | 450 parts |

The mixture of these components was pulverized by a sand mill to an average particle size of 2.5 μm.

(2) Preparation of Dispersion B

| | |
|---|---|
| 4-Hydroxy-4'-isopropoxydiphenyl-sulfone | 300 parts |
| 5% Aqueous solution of methylcellulose | 100 parts |
| 10% Aqueous solution of polyvinyl alcohol (trade name: PVA-105, product of Kuraray Co., Ltd.) | 100 parts |
| Water | 130 parts |

The mixture of these components was pulverized by a sand mill to an average particle size of 2.5 μm.

(3) Formation of recording layer

A 1000 parts quantity of Dispersion A, 400 parts of Dispersion B, 3000 parts of 6% aqueous solution of polyvinyl alcohol (trade name: PVA-124, product of Kuraray Co., Ltd.), 250 parts of finely divided anhydrous silica (trade name: Nipsil E-150K, oil absorption: 185 ml/100 g, average particle size: 4.5 μm, product of Nippon Silica Kabushiki Kaisha) and 50 parts of an aqueous dispersion of zinc stearate (trade name: Hidorin Z-7, solids content: 30%, product of Chukyo Yushi Kabushiki Kaisha) were mixed and agitated, giving a coating composition for heatsensitive recording layer formation.

The coating composition obtained was applied to wood free paper weighing 48 g/m$^2$ with use of an air-knife coater in an amount of 6 g/m$^2$ on dry basis and then dried, thereby forming a heat-sensitive recording layer.

(4) Preparation of coating composition for overcoat layer formation.

A 1000 parts quantity of 6% aqueous solution of polyvinyl alcohol (trade name: PVA-124, product of Kuraray Co., Ltd.), 150 parts of precipitated calcium carbonate (trade name: PZ, product of Shiraishi Kogyo Kabushiki Kaisha), 60 parts of an aqueous dispersion of zinc stearate (trade name: Hidorin Z-7; solids content: 30%) and 1000 parts of water were mixed and agitated, giving a coating composition for overcoat layer formation.

(5) Formation of overcoat layer

The coating composition for overcoat layer formation obtained was applied to the aforementioned heat-sensitive recording layer with use of a bar coater in an amount of 1.0 g/m$^2$ on dry basis, then dried and subjected to super calender treatment, giving a heat-sensitive recording paper having an overcoat layer.

EXAMPLE 2

A heat-sensitive recording paper having an overcoat layer was obtained in the same manner as in Example 1 except that, when forming the overcoat layer, the coating composition for overcoat layer formation was applied in an amount of 0.6 g.m/$^2$ on dry basis and dried.

EXAMPLE 3

A heat-sensitive recording paper having an overcoat layer was produced in the same manner as in Example 1 except that, when forming the recording layer, an agglomerate of finely divided precipitated calcium carbonate (trade name: Calrite SA, oil absorption: 95 ml/100 g, average particle size: 4 μm, product of Shiraishi Calcium Kabushiki Kaisha) was used in place of finely divided anhydrous silica (trade name: Nipsil E-150K).

EXAMPLE 4

A heat-sensitive recording paper having an overcoat layer was prepared in the same manner as in Example 1 except that, when forming the recording layer, finely divided anhydrous silica (trade name: CM, oil absorption: 140 ml/100 g, average particle size: 9 μm, product of Tokuyama Soda Kabushiki Kaisha) was used in place of the finely divided anhydrous silica (trade name: Nipsil E-150K).

EXAMPLE 5

A heat-sensitive recording paper having an overcoat layer was produced in the same manner as in Example 1 except that, when forming the coating composition for overcoat layer formation, ground calcium carbonate (trade name: Softon 1500, product of Bihoku Funka Co., Ltd.) was used in place of precipitated calcium carbonate (trade name: PZ).

COMPARATIVE EXAMPLE 1

A heat-sensitive recording paper having an overcoat layer was produced in the same manner as in Example 1 except that, when forming the recording layer, finely divided anhydrous silica (trade name: Mizukasil P-527, oil absorption: 190 ml/ 100 g, average particle size: 2.5 μm, product of Mizusawa Kagaku Kabushiki Kaisha) was used in place of the finely divided anhydrous silica (trade name:Nipsil E-150K).

COMPARATIVE EXAMPLE 2

A heat-sensitive recording paper having an overcoat layer was produced in the same manner as in Example 1 except that, when forming the recording layer, anhydrous silica (trade name: F-30, oil absorption: 225 ml/ 100 g, average particle size: 17 μm, product of Tokuyama Soda Kabushiki Kaisha) was used in place of the finely divided anhydrous silica (trade name: Nipsil E-150K).

COMPARATIVE EXAMPLE 3

A heat-sensitive recording paper having an overcoat layer was produced in the same manner as in Example 1 except that, when forming the overcoat layer, the coating composition for overcoat layer formation was applied in an amount of 2.5 g/m$^2$ on dry basis and then dried.

COMPARATIVE EXAMPLE 4

A heat sensitive-recording paper having an overcoat layer was produced in the same manner as in Example 1 except that, when forming an overcoat layer, the coating composition for overcoat layer formation was applied in an amount of 0.2 g/m$^2$ on dry basis and then dried.

COMPARATIVE EXAMPLE 5

A heat-sensitive recording paper having an overcoat layer was prepared in the same manner as in Example 1 except that, when forming the recording layer, ground calcium carbonate (trade name: Softon 1500, oil absorption: 25 ml/100 g, average particle size: 4.0 μm, product of Bihoku Funka Co., Ltd.) was used in place of finely divided anhydrous silica (trade name: Nipsil E-150K).

COMPARATIVE EXAMPLE 6

A heat-sensitive recording paper having an overcoat layer was obtained in the same manner as in Example 1 except that, when forming the overcoat layer, a coating composition for overcoat layer formation which contains 2000 parts of 6% aqueous solution of polyvinyl alcohol (trade name: PVA-124), 40 parts of precipitated calcium carbonate (trade name: PZ) and 60 parts of an aqueous dispersion of zinc stearate (trade name: Hidorin Z-7) was used.

COMPARATIVE EXAMPLE 7

A heat-sensitive recording paper having an overcoat layer was produced in the same manner as in Example 1 except that, when forming the overcoat layer, a coating composition for overcoat layer formation which contains 1000 parts of 6% aqueous solution of polyvinyl alcohol (trade name: PVA-124), 200 parts of precipitated calcium carbonate (trade name: PZ), 60 parts of an aqueous dispersion of zinc stearate (trade name: Hidorin Z-7) and 1520 parts of water was used.

COMPARATIVE EXAMPLE 8

A heat-sensitive recording paper having no overcoat layer was produced in the same manner as in Example 1 with the exception of conducting super calender treatment without forming an overcoat layer.

EXAMPLE 6

A heat-sensitive recording paper having an overcoat layer was produced in the same manner as in Example 1 except that, as a pigment for use in the heat-sensitive recording layer, anhydrous silica (trade name: finesil, product of Tokuyama Soda Kabushiki Kaisha) having an average particle size of 12 μm and an oil absorption of 225 ml/100 g was used in place of the finely divided anhydrous silica (trade name: Nipsil E-150K; oil absorption: 185 ml/100 g; average particle size 4.5 μm; product of Nippon Silica Kabushiki Kaisha).

EXAMPLE 7

A heat-sensitive recording paper having an overcoat layer was prepared in the same manner as in Example 1 except that the finely divided anhydrous silica used in the heat-sensitive recording layer was used in an amount of 500 parts by weight in lieu of 250 parts by weight.

EXAMPLE 8

A heat-sensitive recording paper having an overcoat layer was produced in the same manner as in Example 1 except that the binder for forming the heat-sensitive recording layer, i.e., 6%-aqueous solution of polyvinyl alcohol (PVA 124) was used in an amount of 6000 parts in lieu of 3000 parts.

EXAMPLE 9

A heat-sensitive recording paper having an overcoat layer was prepared in the same manner as in Example 1 except that the coating composition for heatsensitive recording layer formation was applied to the paper in an amount of 11 g/m$^2$ in lieu of 6 g/m$^2$ (each on dry basis).

EXAMPLE 10

A heat-sensitive recording paper having an overcoat layer was prepared in the same manner as in Example 1 except that the coating composition for overcoat layer formation was applied in an amount of 1.8 g/m$^2$ in lieu of 1.0 g/m$^2$.

Each of the foregoing heat-sensitive recording papers was evaluated for the following properties. The results are shown in Table 1.

(1) Recording density

With use of a G-III facsimile machine (UF-7, manufactured by Matsushita Graphic Communication Systems, Inc.), recording (copy mode) was conducted and the recording density was measured by Macbeth densitometer (Model RD-914, manufactured by Macbeth Corporation, USA).

(2) Glossiness

This property was measured according to JIS P 8142. When having a glossiness of about 10% or lower, the appearance of the recording paper is very similar to wood free paper.

(3) Pencil writability:

This property was measured by writing with a pencil (hardness "H", product of Mitsubishi Pencil Co., Ltd.) on the recording surface of the recording paper, and evaluated according to the following criteria.

A: The marks written on the recording paper were imparted the same density as when written on wood-free paper.

B: Writing on the recording paper was not so easy as on wood-free paper because of slipperiness of its surface and gave a low density to the written marks.

(4) Ability to fix seal print

This property was determined by affixing a seal to the recording surface of recording paper with a cinnabar seal-ink (Bunka Shuniku No. 50) and rubbing the resulting seal print with a finger 5 seconds after affixing to evaluate the ability to fix seal print. The evaluation was made according to the following criteria.

A: The letters of the seal print substantially retained their original shapes and maintained the distinct contours.

B: The letters failed to retain their shapes and were illegible.

(5) Anti-scratching property

The surface of the heat-sensitive recording paper was lightly scratched with a fingernail and the degree of the undesired color formation was evaluated according to the following criteria.

A: Undesired color formation was not observed.

B: The trace of the fingernail was left and a light undesired color formation was observed.

(6) Evaluation of adhesion of residuary substances

This evaluation was conducted with use of a G-III facsimile machine (UF-7, manufactured by Matsushita Graphic Communication Systems, Inc.) by continuously recording the patterns in which the black-colored portions occupy 50% of the total area until 100 m of the heat-sensitive recording paper was consumed, and then observing the colored residuary substance adhered to the thermal head.

A: Almost no residuary substance adheres to the head and there was no adverse effect on recording.

B: A large amount of residuary substance adhere to the head and this causes difficulty in recording.

TABLE 1

| | Recording density | Glossiness (%) | Pencil writability | Ability to fix seal print | Anti-scratching property | Adhesion of residuary substance |
|---|---|---|---|---|---|---|
| Example 1 | 1.25 | 7.5 | A | A | A | A |
| Example 2 | 1.27 | 7.2 | A | A | A | A |
| Example 3 | 1.27 | 8.5 | A | A | A | A |
| Example 4 | 1.24 | 4.4 | A | A | A | A |
| Example 5 | 1.24 | 5.6 | A | A | A | A |
| Example 6 | 1.20 | 5.0 | A | A | A | A |
| Example 7 | 1.22 | 6.1 | A | A | A | A |
| Example 8 | 1.21 | 9.1 | A | A | A | A |
| Example 9 | 1.26 | 8.3 | A | A | A | A |
| Example 10 | 1.20 | 8.9 | A | A | A | A |
| Comparative Example 1 | 1.27 | 18.0 | A | A | A | A |
| Comparative Example 2 | 1.10 | 3.6 | A | A | A | A |
| Comparative Example 3 | 1.20 | 9.0 | A | B | A | A |
| Comparative Example 4 | 1.27 | 8.5 | A | A | B | A |
| Comparative Example 5 | 1.24 | 10.0 | A | B | A | B |
| Comparative Example 6 | 1.21 | 14.3 | B | B | A | A |
| Comparative Example 7 | 1.15 | 5.0 | A | A | A | A |
| Comparative Example 8 | 1.28 | 6.8 | A | A | B | A |

As seen from Table 1, each of the heat-sensitive recording materials according to the present invention gives a record image of high recording density, is excellent in all of pencil writability, ability to fix seal print and anti-scratcing property, is low in surfaceglossiness and has an appearance and a touch or a feel quite similar to that of ordinary wood free paper.

We claim:

1. A heat-sensitive recording material comprising a support; a heat-sensitive recording layer formed over the support and containing a color forming material, a color developing material which forms a color on contact with the color forming material and a pigment which is about 80 to about 400 ml/100 g in oil absorption according to JIS K 5101 and about 3 to about 15 μm in average particle size; and an overcoat layer formed over the heat-sensitive recording layer and comprising a binder and a pigment, wherein the pigment is used in an amount of about 0.5 to about 3.0 parts by weight per part by weight of the binder and the coating amount of the overcoat layer is about 0.3 to about 2.0 g/m$^2$ on dry basis.

2. A heat-sensitive recording material according to claim 1 wherein the pigment contained in the heatsensitive recording layer is at least one member selected from the group consisting of diatomaceous earth, calcined diatomaceous earth, flux-calcined diatomaceous earth, finely divided anhydrous aluminum oxide, finely divided titanium oxide, magnesium carbonate, finely divided anhydrous silica, magnesium aluminosilicate, agglomerate of finely divided precipitated calcium carbonate, finely divided calcium silicate and calcined clay, and is about 80 to about 400 ml/100 g in oil absorption according to JIS K 5101 and about 3 to about 15 μm in average particle size.

3. A heat-sensitive recording material according to claim 1 wherein the pigment contained in the heatsensitive recording layer has an average particle size of about 3 to about 10 μm.

4. A heat-sensitive recording material according to claim 1 wherein the pigment contained in the heat-sensitive recording layer is used in an amount of about 10 to about 50% by weight based on the total solids content of the heat-sensitive recording layer.

5. A heat-sensitive recording material according to claim 1 wherein the pigment contained in the heatsensitive recording layer is used in an amount of about 15 to about 35% by weight based on the total solids content of the heat-sensitive recording layer.

6. A heat-sensitive recording material according to claim 1 wherein the heat-sensitive recording layer has incorporated therein a binder in an amount of about 2 to about 40% by weight based on the total solids content of the heat-sensitive recording layer.

7. A heat-sensitive recording material according to claim 1 wherein the heat-sensitive recording layer has incorporated therein a binder in an amount of about 5 to about 25% by weight based on the total solids content of the heat-sensitive recording layer.

8. A heat-sensitive recording material according to claim 6 wherein the binder is at least one member selected from the group consisting of starches, hydroxyethyl cellulose, methyl cellulose, carboxymethyl cellulose, gelatin, casein, gum arabic, polyvinyl alcohol, acetoacetylated polyvinyl alcohol, diisobutylene-maleic anhydride copolymer salt, styrene-maleic anhydride copolymer salt, ethylene-acrylic acid copolymer salt, styrene-acrylic acid copolymer salt, styrene-butadiene copolymer, urea resin, melamine resin and amide resin.

9. A heat-sensitive recording material according to claim 1 wherein the coating amount of the heatsensitive recording layer is about 2 to about 12 g/m$^2$ on dry basis.

10. A heat-sensitive recording material according to claim 1 wherein the coating amount of the heat-sensitive recording layer is about 3 to about 10 g/m$^2$ on dry basis.

11. A heat-sensitive recording material according to claim 1 wherein the pigment contained in the overcoat layer is at least one member selected from the group consisting of precipitated calcium carbonate, ground calcium carbonate, talc, kaolin, anhydrous silica, magnesium carbonate, clay, zinc oxide, aluminum oxide, aluminum hydroxide, polystyrene microball, nylon powder, polyethylene powder, urea-formaldehyde resin and starch powder.

12. A heat-sensitive recording material according to claim 1 wherein the pigment contained in the overcoat layer has an average particle size of about 1 to about 5 μm.

13. A heat-sensitive recording material according to claim 1 wherein a binder contained in the overcoat layer is at least one member selected from the group consisting of polyvinyl alcohol, acetoacetylated polyvinyl alcohol, carboxy-modified polyvinyl alcohol, sulfonic acid-modified polyvinyl alcohol, methyl cellulose, ethyl cellulose, hydroxyethyl cellulose, carboxymethyl cellulose, casein, gum arabic, oxidized starch, etherified starch, esterified starch, styrenebutadiene copolymer, vinyl acetate-ethylene copolymer, vinyl acetate-vinyl chloride-ethylene copolymer and methacrylate-butadiene copolymer

14. A heat-sensitive recording material according to claim 1 wherein the coating amount of the overcoating layer is about 0.3 to about 1.5 $g/m^2$ on dry basis.

* * * * *